US007850142B2

(12) United States Patent
Sladojevic et al.

(10) Patent No.: US 7,850,142 B2
(45) Date of Patent: Dec. 14, 2010

(54) MAGNETIC CLAMP

(75) Inventors: Robert Sladojevic, Blackwood (AU); Craig Deleon, Blackwood (AU); Steven Girotto, Blackwood (AU)

(73) Assignee: SRB Construction Technologies Pty. Ltd., Blackwood, South Australia (AU)

( * ) Notice: Subject to any disclaimer, the term of this patent is extended or adjusted under 35 U.S.C. 154(b) by 284 days.

(21) Appl. No.: 11/574,056

(22) PCT Filed: Aug. 23, 2005

(86) PCT No.: PCT/AU2005/001268

§ 371 (c)(1),
(2), (4) Date: May 14, 2007

(87) PCT Pub. No.: WO2006/021035

PCT Pub. Date: Mar. 2, 2006

(65) Prior Publication Data

US 2008/0217825 A1 Sep. 11, 2008

(30) Foreign Application Priority Data

Aug. 24, 2004 (AU) ..... 2004904824

(51) Int. Cl.
*E04G 17/00* (2006.01)
*H01F 7/04* (2006.01)

(52) U.S. Cl. ..... 249/219.1; 335/285; 335/288; 335/295; 269/8

(58) Field of Classification Search ..... 335/285–288, 335/295; 269/8; 294/65.5; 249/219.1
See application file for complete search history.

(56) References Cited

U.S. PATENT DOCUMENTS 5,066,936 A * 11/1991 Hsu ..... 335/295
6,434,894 B2 8/2002 Reymann

FOREIGN PATENT DOCUMENTS

FR 2 820 352 A 8/2002
JP 04313593 A * 11/1992
WO WO 02/11951 A1 2/2002

* cited by examiner

*Primary Examiner*—Ramon M Barrera
(74) *Attorney, Agent, or Firm*—Sughrue Mion, PLLC

(57) ABSTRACT

A magnetic clamp (10) for use in clamping metal formwork in precast concrete manufacture includes a housing (12). A magnet (14) is displaceably arranged within the housing (12). A displacement mechanism (18) is displaceably arranged on the housing (12) to displace the magnet (14) relative to the housing (12). A force amplification mechanism (24) is connected to the magnet (14) and at least a portion of the force amplification mechanism (24) is interposed between the displacement mechanism (18) and the magnet (14).

21 Claims, 11 Drawing Sheets

MAGNETIC CLAMP

This application claims priority from PCT Application No. PCT/AU2005/001268 filed Aug. 23, 2005, and from Australian Patent Application No. 2004904824 filed Aug. 24, 2004, which applications are incorporated herein by reference.

CROSS-REFERENCE TO RELATED APPLICATIONS

The present application claims priority from Australian Provisional Patent Application No 2004904824 filed on 24 Aug. 2004, the contents of which are incorporated herein by reference.

TECHNICAL FIELD

The present invention relates to the clamping of metal formwork. More particularly, the invention relates to a magnetic clamp for use in clamping metal formwork in precast concrete manufacture.

BACKGROUND OF THE INVENTION

In the pre-cast concrete manufacturing industry, concrete members are often pre-made off site in casting yards or factories and then transported to site for erection as required. In a typical casting yard, concrete members are constructed on a steel bed. The advantage of using a steel bed is that the members can be constructed to a high degree of accuracy thus leaving an accurate finish on that surface of the concrete member in contact with the steel bed.

Sideforms are used to define the dimensions of the concrete members. Traditionally the sideforms are screwed or bolted to the steel bed. Once the concrete has been poured and allowed to cure, the screws/bolts and sideforms are removed. The cast concrete members are then lifted from the bed and the process repeated to form another member. However concrete members have become increasingly architectural having differing sizes and shapes. Therefore, if the concrete area of the new member to be cast is larger than the area of the previous member then the holes in the steel bed have to be patched so that the hole does not form an imprint in the next concrete member to be cast. Patching is often performed by welding the bolt holes then grinding them flush with the steel bed. However welding of the holes warps the steel beds as a result of the heat expanding the metal and this causes the steel beds to buckle and bow locally leaving imperfections in the surface of the concrete member. Moreover, this process is particularly labour intensive as the steel beds constantly require repair.

Other means of patching involve plugging the hole with a steel plug or cone and then grinding it flush with the bed. However forcing the plugs into the holes is found to cause a depression in the bed in the locality of the plug causing imperfections in the surface of the steel bed. Once again, the imperfection may form an imprint in the surface of the concrete member being cast. The grinder blades used to remove excess material from the plug also wear down the surface of the steel bed causing depressions in the bed's surface which again adversely affects surface of the concrete member being cast.

Still further means of patching involve plugging the hole with a plastic plug or cone and then grinding it flush with the bed. However it has been found that plastic plugs do not expand and contract at the same rate as the steel beds and do not give as good a finish, generally leaving either a protrusion or depression which is transferred to the surface of the concrete member.

More recently pre-casters have converted to using magnets to reduce the above-described damage.

The simplest form of precast magnetic clamp has an exposed magnetic pack and lever to engage and disengage the magnetic pack from a steel bed. The packs are placed in position on the steel bed and the sideforms placed against them, following which the sideform is attached to the magnetic pack by steel plates and screws. These packs are permanently magnetic and as soon as they are brought near the steel bed surface they exert a substantial amount of magnetic pull on the bed thus making it extremely difficult to position the magnets accurately. Once they engage they are difficult to move and adjust. They are unsafe to use as they can readily and easily clamp over limbs caught between the surface of the steel bed and the magnetic pack. To disengage the magnetic pack there is a lever on one or both sides of the pack that physically pushes the magnetic pack away from the steel bed so as to break the magnetic bond with the bed. The pack is physically pulled away from the steel bed by hand until such time as it is far away enough for the magnetic field not to have any substantial influence between the magnetic pack and bed. These magnetic clamps inhibit an operator from making simple and easy adjustments to the position of the sideform once the magnetic pack is engaged, aside from using a heavy object such as a mallet to manoeuvre the magnetic pack into position by force.

A second form of precast magnetic clamp has an exposed magnetic pack and a screw-down pin engagement/disengagement mechanism. These magnetic clamps differ in that rather than being separated from the steel bed via a lever of some sort they are separated from the steel bed via a threaded pin running through the magnetic pack from top to bottom. As the threaded bolt or pin is turned down into the magnetic pack the pin extends out through the bottom of the magnetic pack past the bottom face thus pushing the magnetic pack away from the steel bed breaking the magnetic bond and allowing the magnetic pack to be lifted from the bed.

A third form of precast magnetic clamp has an exposed plastic magnetic pack and operates either via a side lever action disengagement mechanism or a screw down pin disengagement mechanism. Instead of a lever used to push one end of the magnet up from the steel bed a threaded bar is located in the magnet body. When the threaded bar is screwed into the magnet body it protrudes past a bottom face of the magnet thus pushing the magnet body up and away from the steel bed.

The magnetic clamps with the screw down pins or threaded bars have the same drawbacks as the previously described magnetic pack magnets in that the operator still cannot make any adjustments to the position of the magnet and sideform after the magnet is placed on the steel bed. They are also very slow and cumbersome to use and the threads are subject to getting clogged with concrete thus making them inoperable.

A fourth form of precast magnetic clamp comprises a magnetic pack located within a housing with the magnetic pack moving vertically within the housing via either a screw mechanism or lever action. In use these clamps are able to be attached to the sideform and then engaged to the steel bed by moving the magnetic pack down through the housing on to the bed via either screws or a lever. The screw action is slow and cumbersome and prone to fouling of the thread by concrete. The same happens for the lever action as well as requiring the operator to constantly rely on and carry a long lever so as to give the operator enough leverage to pull the magnetic pack away from the steel bed.

A fifth form of precast magnetic clamp comprises a magnetic pack located within an open split housing where the magnetic pack is permanently fixed to the internal section of the open housing and then this internal section moves up and down within the external section of the housing. The housing is basically open in the sense that it only has sides, hence it has an open top and an open bottom. A plate containing the magnetic pack is hinged at the front of the magnet and simply drops down through the housing to allow the magnetic pack to attach to the steel bed. These magnets are cumbersome to use in that an operator cannot have the magnet attached to the sideform and make adjustments to the sideform for the magnet needs to be attached to position the sideform. Another problem is that a very long lever bar is required to disengage the magnet from the steel bed. Whilst levering the magnet from the bed, due to the excessive applied, leverage force the magnets tend to jump up during disengagement. Moreover, the hinge joint at the front wears causing the magnet to engage very quickly to the steel bed causing major safety issues.

SUMMARY OF THE INVENTION

According to the invention, there is provided a magnetic clamp for use in clamping metal formwork in precast concrete manufacture, the clamp including:

a housing;

a magnet displaceably arranged within the housing;

a displacement mechanism displaceably arranged on the housing to displace the magnet relative to the housing; and a force amplification mechanism connected to the magnet, at least a portion of the force amplification mechanism being interposed between the displacement mechanism and the magnet.

The displacement mechanism may include a handle operable to move the magnet between a first, disengaged position and a second, operative position in which the magnet is substantially fully in contact with a steel bed on which the clamp is mounted for use. The handle may be pivotally connected to the housing adjacent a first end of the housing. The handle may comprise a pair of lever arms, the pair of lever arms being interconnected at their free ends by a handle bar.

In a first embodiment, the force amplification mechanism may comprise a linkage mechanism. The linkage mechanism may include a pair of links associated with each lever arm of the handle. A first link may be carried by an end of the lever arm opposite its free end and a second link may interconnect the first link and a first end of the magnet at the first end of the housing, i.e. a displaceable end of the magnet, the second link being pivotally attached to the magnet and to the first link.

The length of the lever arms may be substantially greater than the length of the links such that, when the clamp is in the operative position, the force applied by the lever arms to the first end of the magnet to move the magnet from its operative position to the disengaged position is amplified.

In a second embodiment, the force amplification mechanism may include a cam mechanism. The cam mechanism may comprise a bore in each end of the lever arm opposite the free end of the lever arm, each bore being eccentrically arranged relative to a centre of rotation of the lever arm, and a shaft interconnecting the bores. The shaft may co-operate with a follower arrangement carried by the magnet. The follower arrangement may be formed by a pair of slots, the slots being arranged on opposite sides of the magnet adjacent a first end of the magnet at the first end of the housing.

The clamp may include a limiting device to limit the extent of displacement of the displacement mechanism and magnet relative to the housing.

In a first example, a portion of the force amplification mechanism may be operable as the limiting device. For instance, the dimensions of each of the slots may limit the extent of displacement of the displacement mechanism.

In a second example, a portion of the housing and the displacement mechanism may be operable as the limiting device. In this example, a stop block may be arranged to extend inwardly from an interior surface of a side wall of the housing. In addition, an eccentric may extend from a portion of the displacement mechanism in such a way that the eccentric engages the stop block to limit the extent of displacement of the displacement mechanism.

In a third example, the force amplification mechanism may be operable as the limiting device. An eccentric may protrude from a region of the force amplification mechanism and may be arranged to come into contact with an interior region of the housing or a protrusion extending from an interior region of the housing to limit the extent of displacement of the displacement mechanism.

The clamp may further include a demagnetising plate to maintain the position of the magnet relative to the housing when in the disengaged position. The demagnetising plate may be positioned on or adjacent an interior surface of a roof of the housing. The demagnetising plate may be formed integrally with the roof of the housing as a one-piece unit.

The housing may be cast from steel, an alloy, a polymer, or the like.

A second end of the magnet may be pivotally connected adjacent the second end of the housing, i.e. at an end opposite the displaceable end of the magnet. This may be achieved by way of a pivot bar which passes through the magnet and housing.

The magnet may comprise a plurality of magnetic inserts carried in carriers, which may be steel plates. The magnet may comprise baffle plates sandwiched between the carriers. In use, the baffle plates may advantageously increase the frictional coefficient between the magnet and a steel bed on which the clamp is positioned. The baffle plates may be manufactured from a resiliently flexible material. The baffle plates may provide a water resistant protective coating to the magnet plates and further provide for absorbing vibrational impacts.

Further, the clamp may include a sideform connector plate releasably connectable to an exterior region of the housing to enable the clamp to be releasably connected to a sideform.

The clamp may also include a compensation member releasably connectable to an exterior region of the housing for absorbing vibrational impacts, the compensation member being arranged between the connector plate and the front end of the housing. The compensation member may be manufactured from an elastomeric material, such as rubber or other like material. The arrangement of the compensation member on the housing may enable the housing to compensate for irregularities in the surface of the bed on which the clamp is placed.

Still further, the clamp may include a retaining member arranged to enable the magnet to be suspended in a position intermediate its first position and its second position.

The clamp may include a skirt arranged to increase a frictional coefficient between the magnet and a steel bed when the magnet is positioned on the steel bed. The skirt may be manufactured from an elastomeric material such as rubber. The skirt may be arranged to increase lateral shear capacity of the clamp. The skirt may further be arranged about a periphery of an opening of the housing to inhibit the entry of debris into the housing.

The clamp may also include a cover releasably attached to the housing. The cover may be arranged such that, in use, spillage on to the housing is deflected by the cover away from the housing. The cover may be manufactured from an elastomeric material, such as rubber. Rubber has the advantage that it is unaffected by the alkalinity of concrete and being flexible it will substantially prevent cured concrete from bonding to the cover plate.

BRIEF DESCRIPTION OF THE DRAWINGS

Embodiments of the invention will now be described with reference to the accompanying drawings, in which.

DESCRIPTION OF EXEMPLARY EMBODIMENTS

Figure 1:
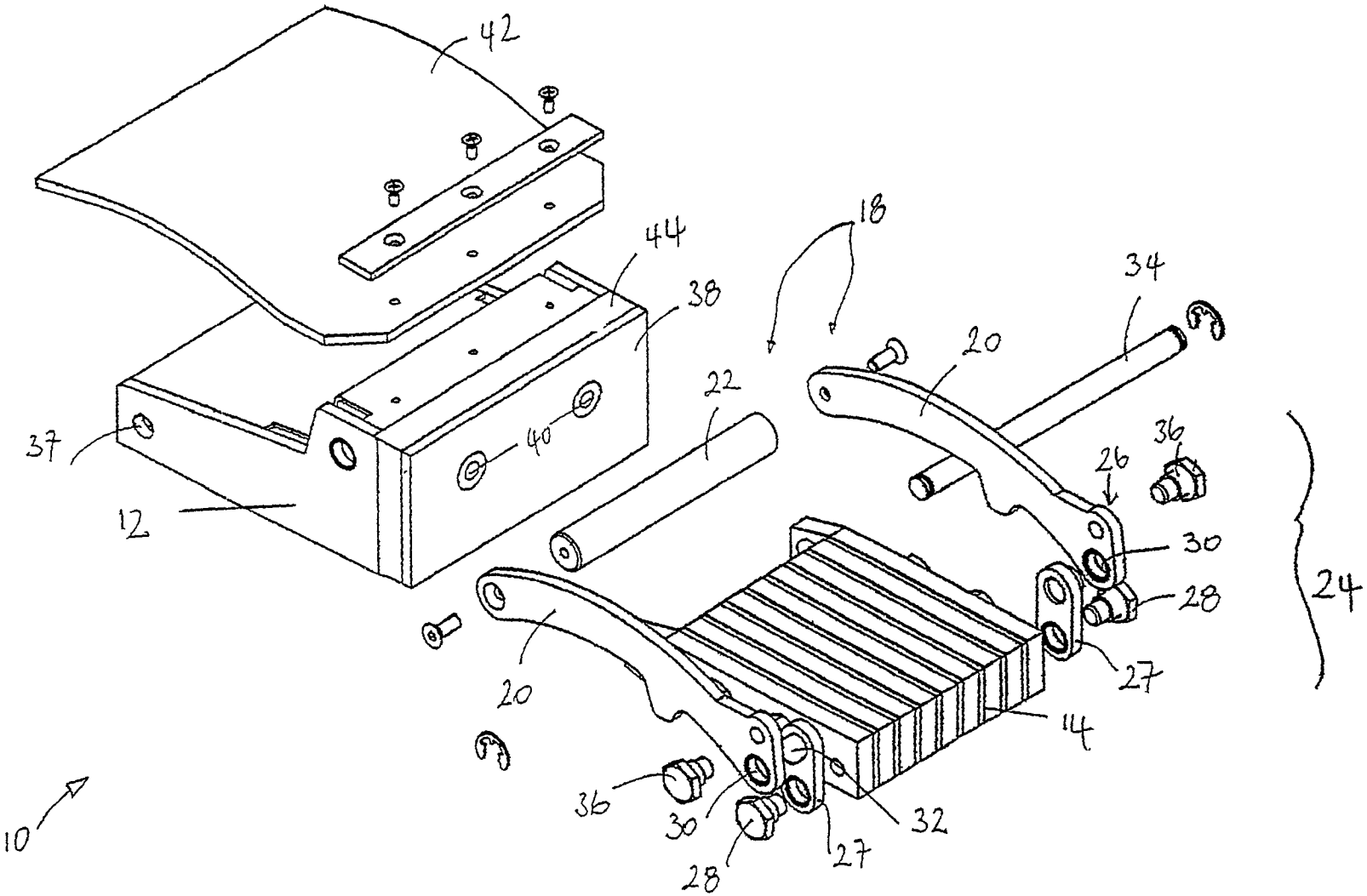
FIG. 1 is an exploded view of a first embodiment of a magnetic clamp for use in clamping metal formwork in precast concrete manufacture.
Figure 2:
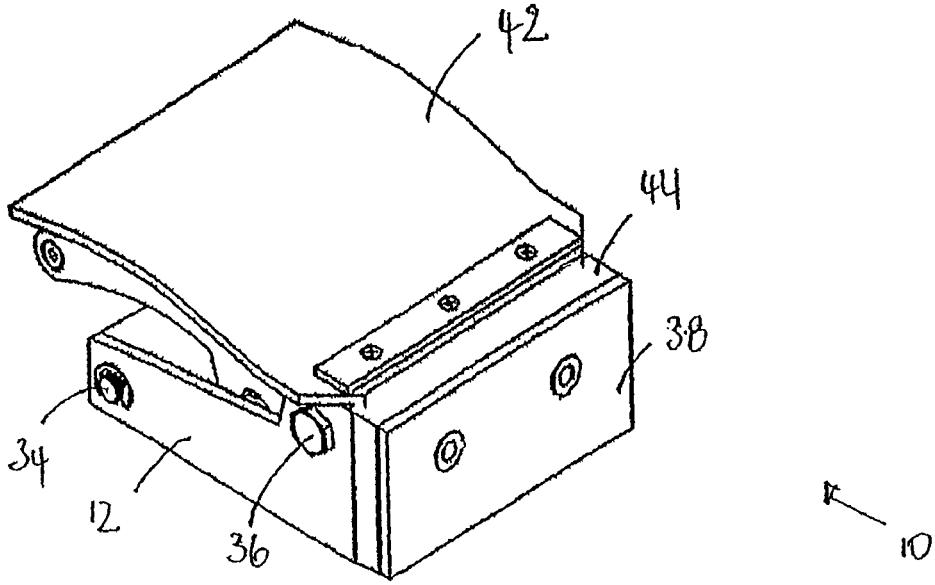
FIG. 2 is a perspective view of the clamp illustrated in FIG. 1.
Figure 3:
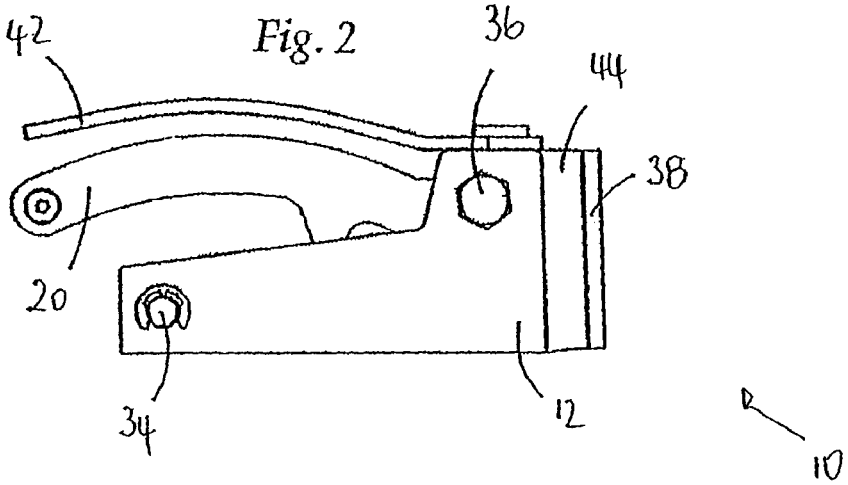
FIG. 3 is a side view of the clamp illustrated in FIG. 1.
Figure 4:
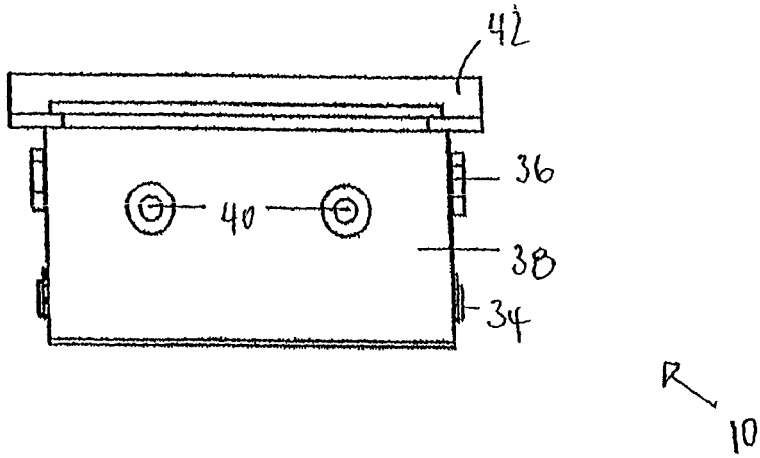
FIG. 4 is a front view of the clamp illustrated in FIG. 1.
Figure 5:
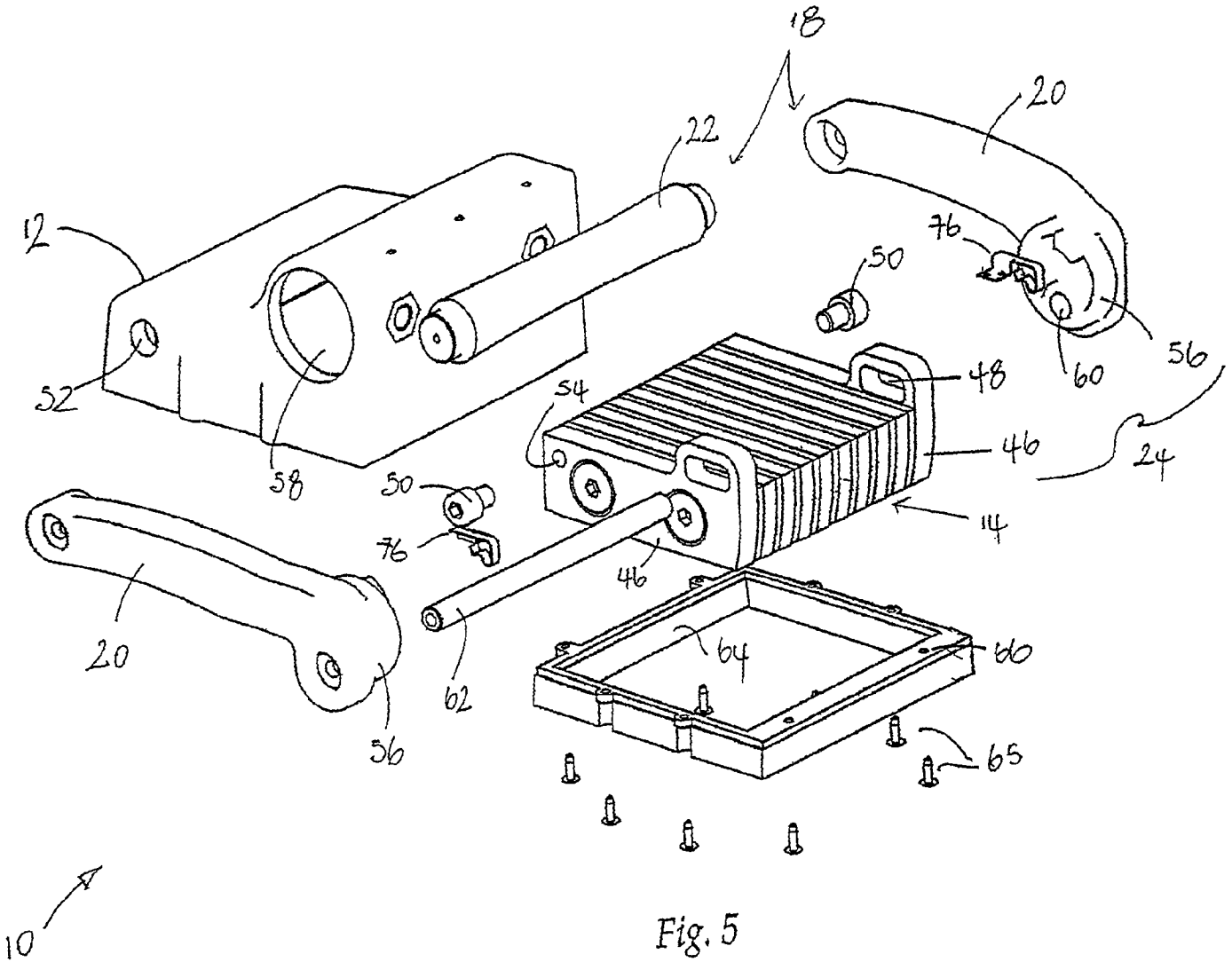
FIG. 5 is an exploded view of a second embodiment of a magnetic clamp for use in clamping metal formwork in precast concrete manufacture.

A first embodiment of a magnetic clamp 10 for use in clamping metal formwork in precast concrete manufacture is illustrated in FIGS. 1 to 4 of the drawings. The clamp 10 includes a housing 12 and a magnet 14 received in the housing 12. The clamp 10 further includes a displacement mechanism in the form of an actuator handle 18 to displace the magnet 14 relative to the housing 12. The handle 18 includes a pair of lever arms 20 operable to move the magnet 14 between a first, disengaged position and a second, operative position in which the magnet 14 is substantially fully in contact with a magnetic bed (not shown in this embodiment) made of steel or other material capable of being attracted by a magnet used in the casting process. The lever arms 20 are pivotally connected at their first end to the housing 12 adjacent a first end of the housing 12. Free ends of the lever arms 20 are interconnected by a handle bar 22.

The clamp 10 further includes a force amplification mechanism 24 in the form of a linkage mechanism which includes a pair of links 26, 27 associated with each lever arm of the handle 18. The first link 26 is integrally formed with the first end of the lever arm 20. The second link 27 interconnects the first link 26 and that end of the magnet 14 at the first end of the housing 12, i.e. a substantially vertically displaceable end of the magnet. The second link 27 is pivotally attached to the magnet 12 by a bolt 28. The second link 27 is pivotally attached to the first link 26 by a pin 32 protruding from the second link 27 that passes through an offset hole 30 in the first link 26.

A pivot pin in the form of a steel shaft 34 passes through holes 37 in sides of the housing 12, proximate an opposed, second end of the housing, and through the magnet 14 to create a pivot axis about which the magnet 14 pivots relative to the housing 12. Pushing down on the handle bar 22 causes the magnet 14 to pivot on the steel shaft 34 with the front end of the magnet 14 travelling downward until the entire magnet 14 is horizontal and is fully in contact with the steel bed. To disengage the magnet 14 from the steel bed, the handle bar 22 is pulled upwardly to cause the magnet 14 to pivot about the shaft 34 pulling the front end of the magnet 14 out of contact with the steel bed.

Each lever arm 20 is connected to the housing 12 via a screw 36, the screw 36 defining a pivot axis for each lever arm 20 to pivot relative to the housing 12. The length of each lever arms 20 is much greater than the distance between the centres of rotation of the pin 32 and the bolt 28. A moment applied to the lever arms 20 is transferred to the links 27. The moment applied to the levers arms 20 is M and is the product of $F_1 \times d_1$, where '$F_1$' is the force exerted on the lever arms 20 and '$d_1$' is the length of the lever arms 20.

The force therefore applied to the links 27 is $F_2 = M \div d_2$ where $d_2$ is the distance between the centres of rotation of the pin 32 and the bolt 28. Since $d_2$ is significantly less than $d_1$, this results in a proportionally much larger force being exerted on the links 27 to pull up the front end of the magnet 14. Accordingly the force amplification mechanism 18 greatly amplifies the force exerted by the lever arms 20 at the links 27 to lift the front end of the magnet 14 thus reducing the force needed to be applied by an operator to break the magnetic force holding the clamp 10 to the steel bed.

This obviates the need for any long levers or bars to be used to separate the clamp 10 from the steel bed as a relatively small force applied by the operator is amplified sufficiently to break the magnetic force between the steel bed and the magnet 14.

The clamp 10 includes a sideform connector plate 38 which has two threaded holes 40 to which various adaptor plates (not shown) are able to be connected to enable the clamp 10 to be secured to a sideform.

Advantageously, the clamp 10 can be connected to a sideform whilst the magnet 14 is in its tilted, disengaged position in the housing 12. The magnet 14 can pivot upwardly from the steel bed without in any was disturbing the position of the housing 12 or causing it to tilt enabling the clamp 10 to be attached to the sideform whilst the magnet 14 is disengaged from the steel bed.

A rubber cover plate 42 is affixed to the housing 12. The cover plate 42 is larger than the housing 12 so that, in use, any concrete spillage on to the housing 12 will be deflected by the cover plate 42 away from the housing 12 itself. Being made from rubber, the cover plate 42 is unaffected by the alkalinity of concrete and being flexible it inhibits the concrete sticking to the cover plate 42. The cover plate 42 is simply unscrewed and lifted off for cleaning. The cover plate 42 is fitted to the housing 12 to overlie the handle 18.

The clamp 10 further includes a rubber compensation plate 44 for enabling the housing 12 to adjust and compensate for any irregularities in the surface of the steel bed on which the clamp 10 is positioned. The rubber compensation plate 44 also provides vibration and impact absorption. In use, the sideforms are attached to the sideform connector plate 38 so that when the housing 12 is placed in a position on the steel bed that is lower than the base of the sideform, the rubber compensation plate 44 flexes vertically to compensate for the difference in elevation as well as flexing horizontally to facilitate the maintenance of the sideform in a perpendicular orientation relative to the steel bed. This helps to reduce the likelihood of the front of the magnet 14 being elevated which severely reduces its holding and support capabilities.

A second embodiment of a magnetic clamp 10 for use in clamping metal formwork in precast concrete manufacture is illustrated in FIGS. 5 to 19 of the drawings. With reference to FIGS. 1 to 4 of the drawings, like reference numerals refer to like parts unless otherwise specified. The force amplification mechanism 24 is in the form of a cam mechanism which performs a similar function to the linkage mechanism described above in relation to FIGS. 1 to 4.

The magnet 14 has two steel end plates 46 of which a section at the front is elevated extending above a top of the magnet 14. The raised section of each of the end plates 46 defines a horizontally extending slot 48, the slots 48 acting as a follower arrangement as will be described below. These horizontally extending slots 48 are parallel with the top of the magnet 14.

The magnet 14 is pivotally retained in the housing 12 by two pivot pins 50 received through pivot holes 52 in sides of the housing 12. The pins 50 are received in threaded holes 54 in the end plates 46 of the magnet 14.

The cam mechanism comprises an inwardly protruding pivot disc 56 arranged at the front of each lever arm 20. Each disc 56 is received in an opening 58 in the side of the housing 12. The diameter of the opening 58 approximates that of its associated disc 56 so that the disc is snugly, but rotatably, retained in the opening. 58.

A bore 60 is eccentrically defined in each disc 64. A shaft 62 is received through the slots 48 with ends of the shaft 62 being received in the bores 60. When the lever arms 20 are rotated, the bores 60 travel in a circular arc around the centre of rotation of the discs 56 which causes the shaft 62 to follow an arc around the rotational centre of the discs 56 and to act as a cam acting on the follower arrangement formed by the slots 48.

The slots 48 function as lost motion links so that only vertical movement of the magnet 14 relative to the housing 12 results from displacement of the shaft 62.

Figure 7:
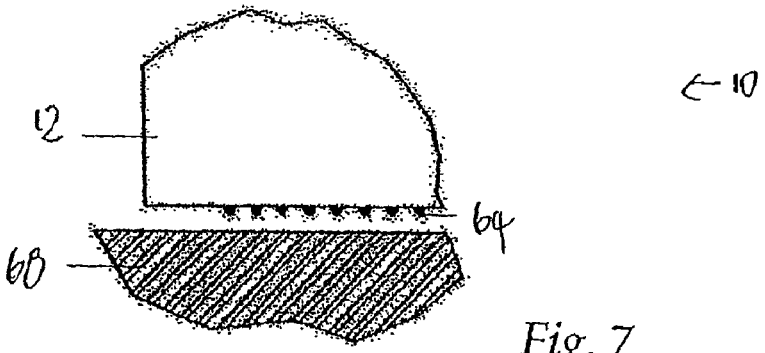
FIG. 7 is a cross sectional side view of a portion of the clamp illustrated in FIG. 6 disengaged from a steel bed.
Figure 9:
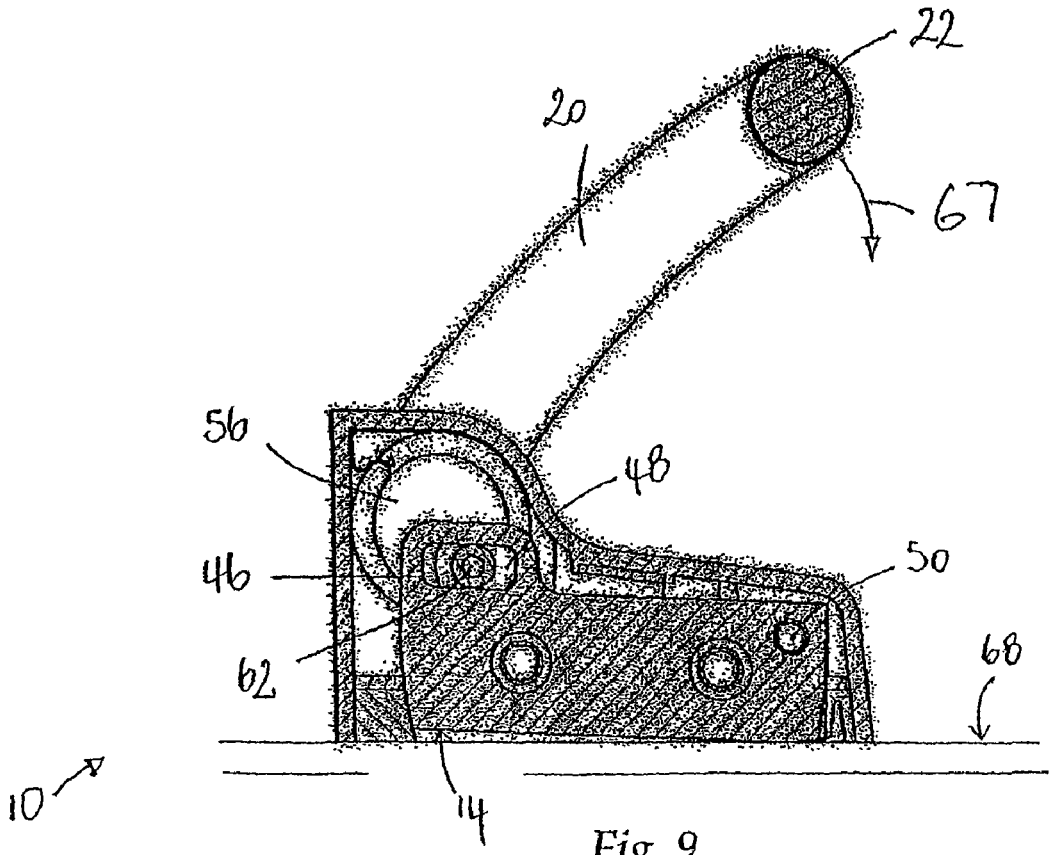
FIG. 9 is a cross sectional side view of the clamp illustrated in FIG. 5 disengaged from the steel bed.
Figure 10:
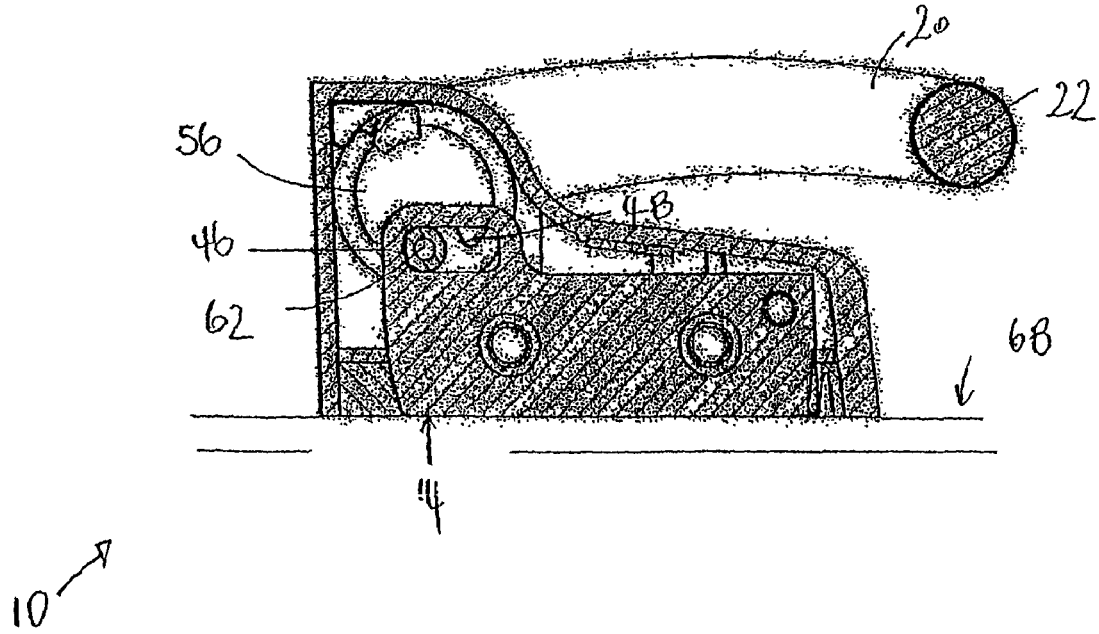
FIG. 10 is a cross sectional side view of the clamp illustrated in FIG. 5 in contact with the steel bed.

As illustrated in FIG. 9 of the drawings, when the handle 18 is in a raised position, at least a front portion of the magnet 14 is out of contact with a steel bed 68 (FIG. 7). The shaft 62 is located approximately half way along the slots 48 in the end plates 46.

As the handle 18 is urged downwards in the direction of arrow 67, the discs 56 rotate in their openings 58 causing the shaft 62 to travel in an arc around the centre of rotation of the discs 56. Because the shaft 62 is constrained by the slots 48 to move horizontally, the magnet 14 is driven into contact with the bed 68.

The length of each lever arm 20 is much greater than the distance from the centre of rotation of the pivot disc 56 to the centre of the bores 60. The moment applied by the lever arms 20 is $M=F_1 \times d_1$, where '$F_1$' is the force exerted on the lever arms 20 and '$d_1$' is the length of the lever arms 20. This moment is transferred from the pivot point of the lever arms 20 to the shaft 62. The force imparted by the shaft 62 on the magnet 14 to raise the magnet 14 is $F_2=M \div d_2$, where $d_2$ is the distance between the centre of rotation of the disc 56 and the centre line of the shaft 62.

Because $d_2$ is substantially less than $d_1$, dividing the initial moment M by a substantially shorter distance will result in a proportionally much larger force being exerted by the shaft 62 on the front end of the magnet 14. Consequently, the force amplification mechanism 24 greatly amplifies the force exerted on the lever arms 20 at the shaft 62 and facilitates lifting the front end of the magnet 14 thus breaking the magnetic force holding the clamp 10 attached to the steel bed 68. Once again, this obviates the need for any long levers or bars to be used to separate the magnetic clamp 10 from the precast steel bed 68 as a relatively small force from the operator is amplified to break the magnetic force between the steel bed 68 and the magnet 14.

The clamp 10 includes a friction grip skirt 64 which is affixed to the housing 12 via screws 65. The skirt 64 protrudes below a bottom surface of the housing 12. The skirt 64 is manufactured from a soft rubber compound to allow for maximum deformation and maximum friction between the steel bed 68 and the skirt 64. The softer the rubber compound used the greater the frictional force attained. The skirt 64 is laminated to a rigid frame 66 which provides a backing.

Figure 6:
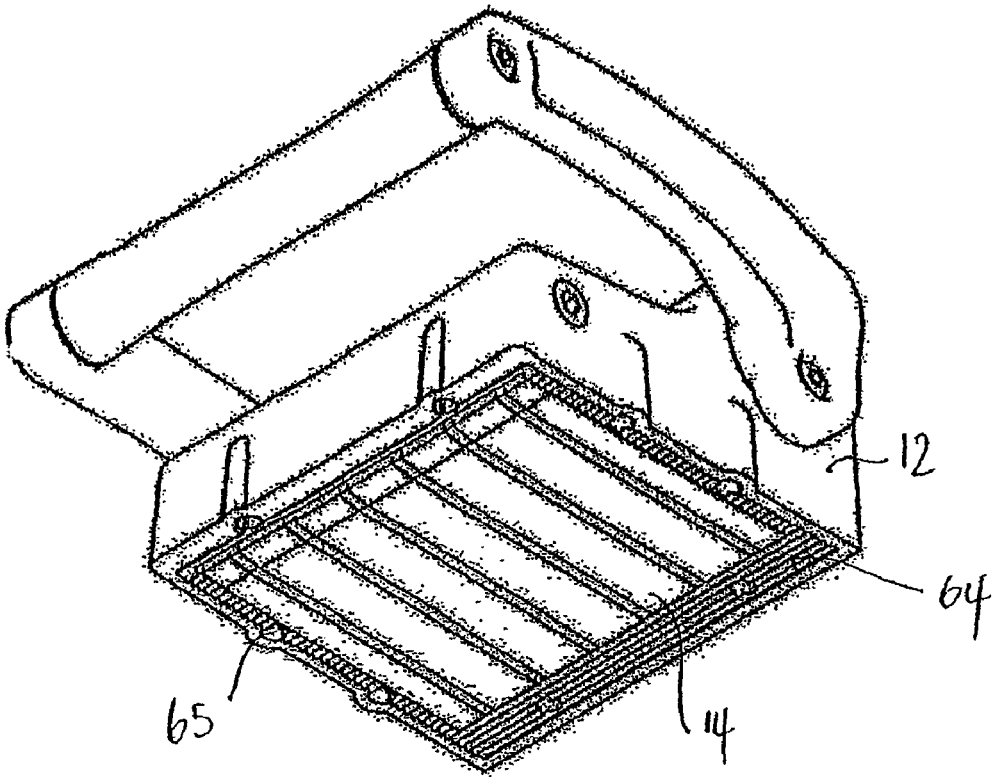
FIG. 6 is a perspective underside view of the clamp illustrated in FIG. 5.

As illustrated in FIG. 6 of the drawings, the skirt 64 fits snugly around the magnet 14 to inhibit the ingress of detritus into the interior of the housing 12. The profile of the skirt 64 is designed so as to follow the arcuate motion of the magnet 14. A bottom surface of the skirt 64 (the face that is in contact with the steel bed) is roughened, for example, by being serrated, to enhance grip.

Figure 8:
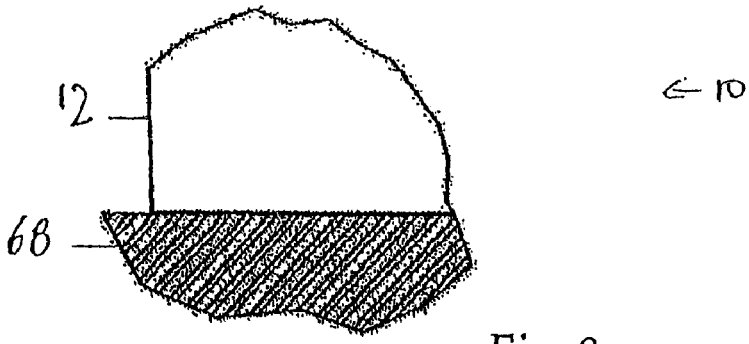
FIG. 8 is a cross sectional side view of a portion of the clamp illustrated in FIG. 6 in contact with the steel bed.

FIG. 7 illustrates a small section of the clamp 10 being lowered into contact with the steel bed 68. As illustrated in FIG. 8, when the magnet 14 comes into contact with the steel bed 68, the magnetic attraction force of the magnet on to the steel bed 68 compresses the part of the skirt 64 extending past the housing 12 and the magnet 14 until the magnet 14 and the housing 12 are in contact with the steel bed 68. Advantageously, larger shear forces can be achieved than with a clamp without a skirt and/or smaller magnets can be used.

A bottom of the magnet 14 is able to be cleaned, for example, by being brushed, to remove metallic particles. When such cleaning occurs, the metallic particles accumulate on the skirt 64 and inhibit accumulation of the particles on sides of the magnet 14. Because the skirt 64 is non-magnetic, the particles can be removed easily.

As there are strong magnetic forces being exerted by the magnet 14, the lever arms 20 can be pulled down or up with extreme ferocity by the magnetic force and can be extremely dangerous if the lever arms 20 shear or hit against the housing 12 or even the steel bed 68, particularly as limbs or appendages of the operator could be caught between the lever arms 20 or a lever arm 20 and the housing 12 or the steel bed 68.

In this embodiment of the invention, the magnetic clamp 10 has a limiting device to control and limit the movement of the lever arms 20 and the magnet 14 within the housing 12.

Figure 11:
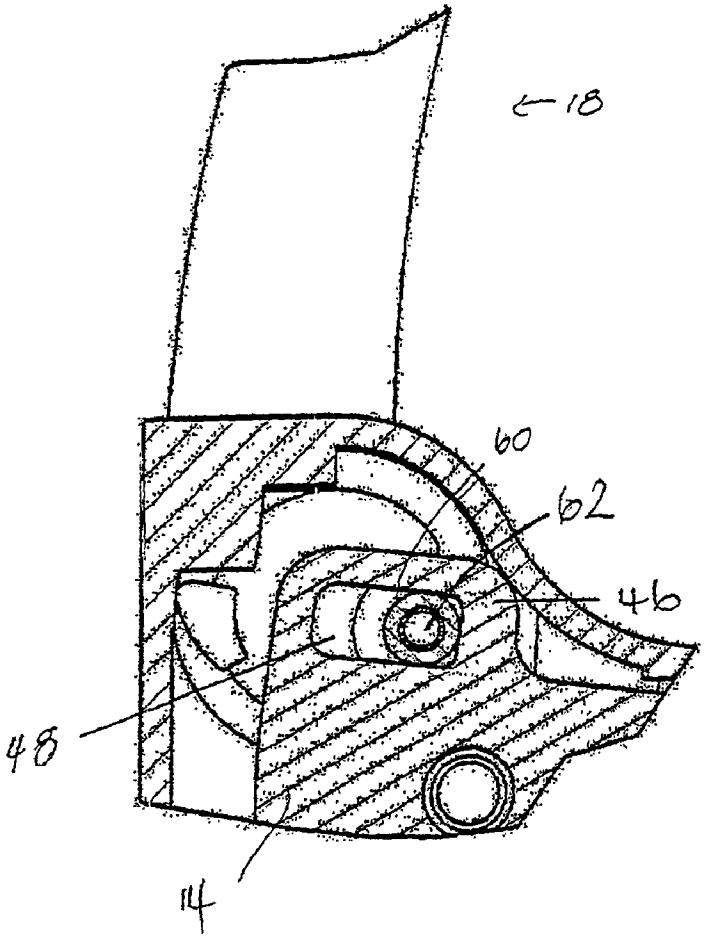
FIG. 11 is a cross sectional enlargement of a portion of a first example of the second embodiment of the clamp in a disengaged position.
Figure 12:
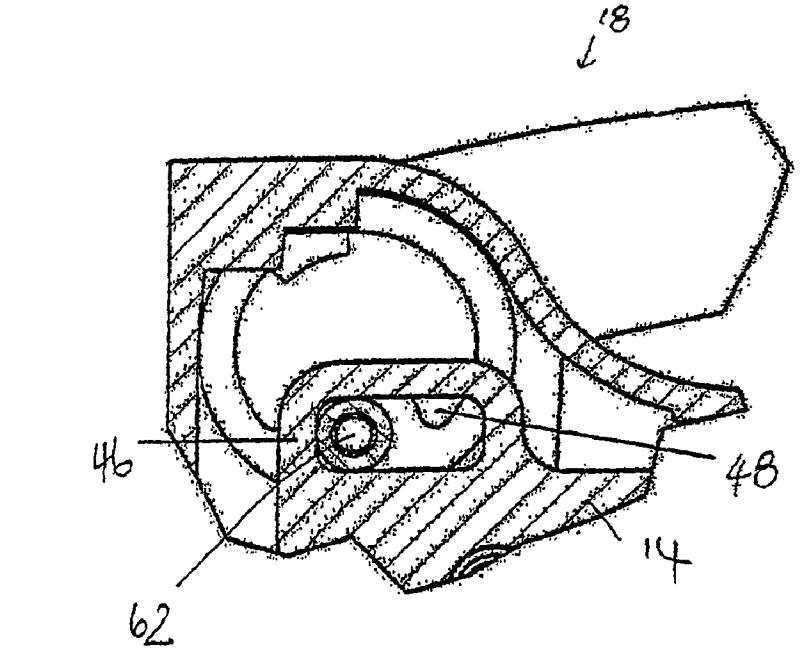
FIG. 12 is a cross sectional enlargement of the portion of the first example of the second embodiment of the clamp in an operative position.

In one example, as illustrated in FIGS. 11 and 12 of the drawings, the slots 48 of the magnet 14 are used as the limiting device. The shaft 62 is held captive in the slots 48 thereby controlling the limits of movement of the handle 18.

Figure 13:
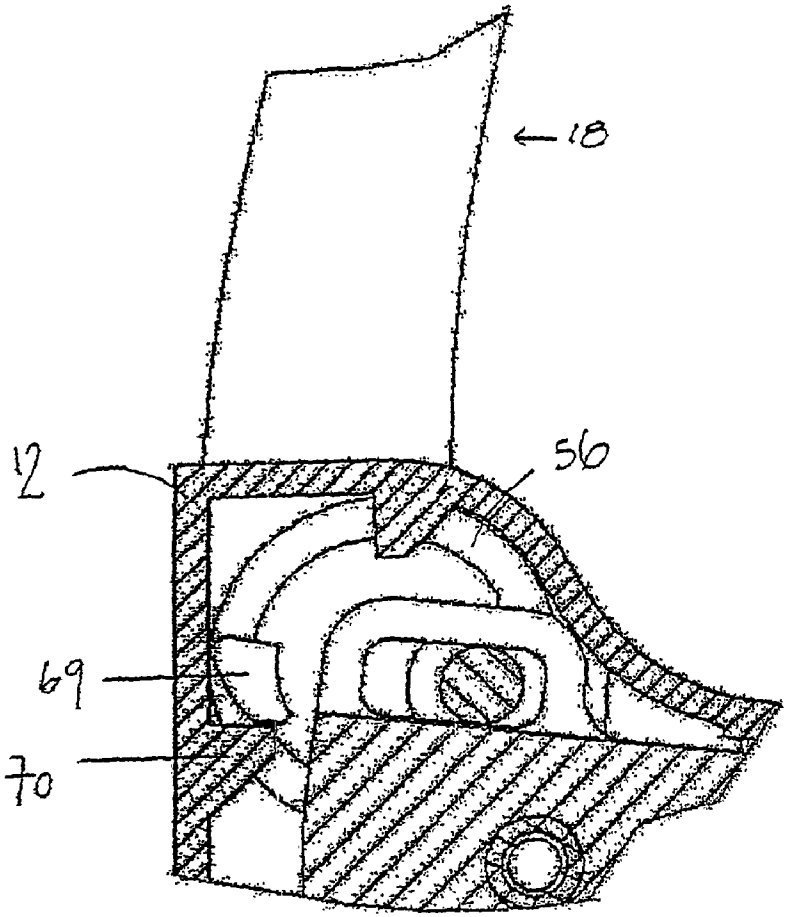
FIG. 13 is a cross sectional enlargement of a portion of a second example of the second embodiment of the clamp in a disengaged position.
Figure 14:
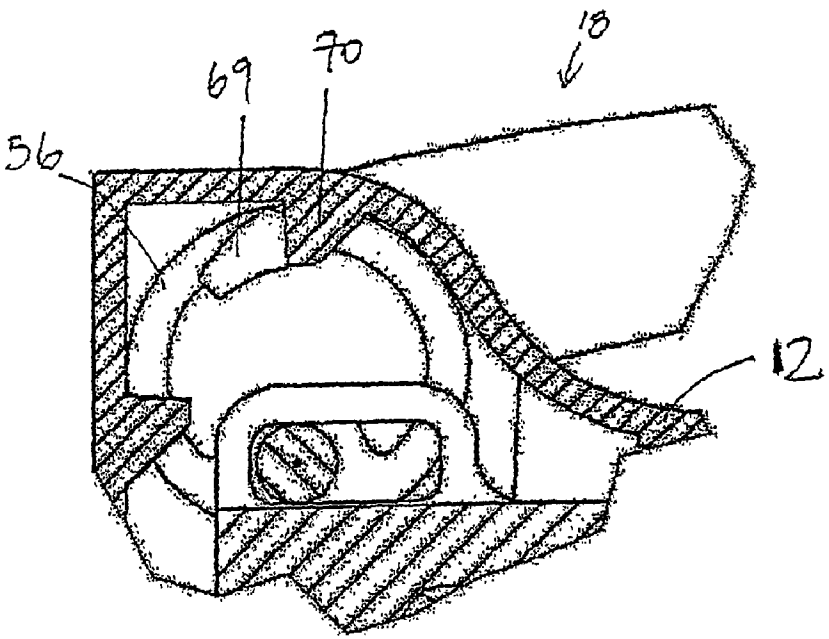
FIG. 14 is a cross sectional enlargement of the portion of the second example of the second embodiment of the clamp in an operative position.

In a second example, as illustrated in FIGS. 13 and 14 of the drawings, the housing 12 defines part of the limiting device. An eccentric 69 is attached to the pivot disc 56. Orthogonally spaced stops 70 are arranged within the housing and extend into the housing 12 to be engaged by the eccentric 69 to control the limit of movement by the handle 18.

Figure 16:
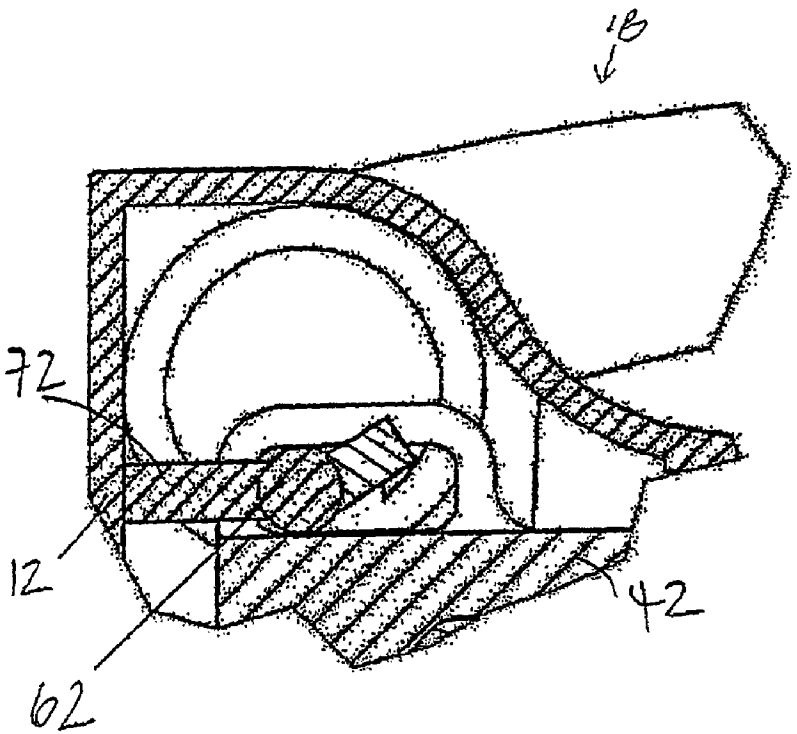
FIG. 16 is a cross sectional enlargement of the portion of the third example of the second embodiment of the clamp in an operative position.
Figure 15:
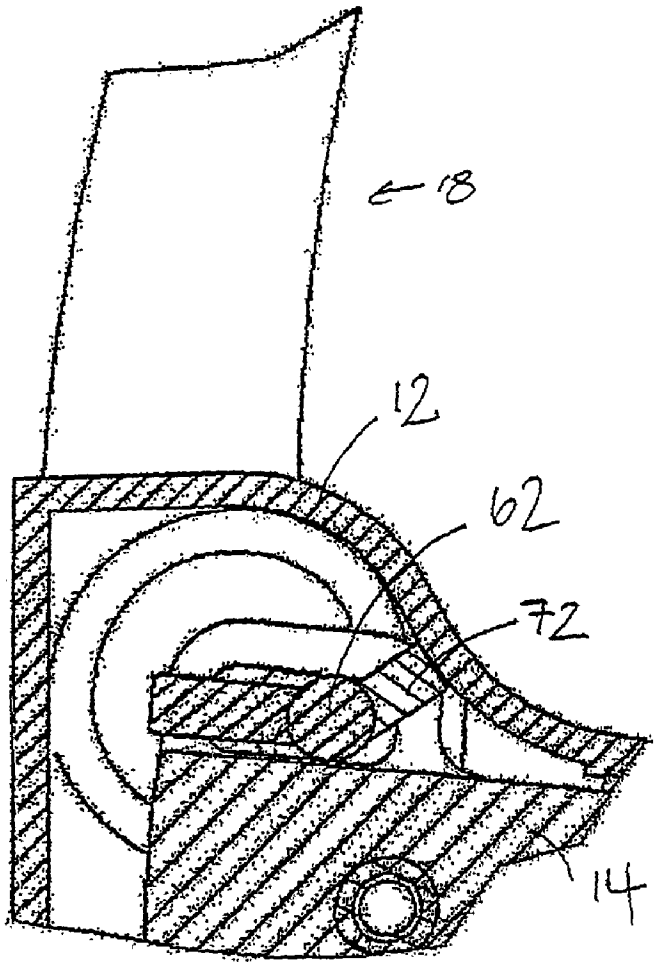
FIG. 15 is a cross sectional enlargement of a portion of a third example of the second embodiment of the clamp in a disengaged position.

In a third example of a limiting device, leading and trailing stops 72 are carried on the shaft 62 as illustrated in FIGS. 15 and 16 of the drawings. One of the stops 72 abuts against a first part of the interior surface of the housing 12 when the handle 18 is at a first extreme of movement and the other stop abuts against a second part of the interior surface of the housing 12 when the handle is at a second extreme of movement thereby limiting the movement of the handle 18.

In all three examples, the limiting device is internally located. It is important to limit the motion of the handles 18 and the magnet 14 by a device within the housing 12 for safety reasons. If the magnet 14 can travel past the housing 12 this can be extremely dangerous to an operator whilst the operator is placing the magnetic clamp 10 into position. As the operator lowers the magnet 14 closer and closer to the steel bed 68 the magnetic attractive force between the magnet 14 and the steel bed drastically increases. If the operator is holding the housing 12, the magnet 14 could travel downward beyond the housing 12. This could cause the magnet 14 to drop rapidly and with an immense force below the housing 12 and attach itself with great speed and force to the steel bed 68. If any of the operator's limbs or appendages are in the path of the magnet 14 they could be severely injured. A similar scenario would apply in respect of uncontrolled movement of the handle 18.

It will further be appreciated that similar limiting devices are employed in the first embodiment of the invention described above with reference to FIGS. 1 to 4 with the appropriate element being carried by the links 26 and/or 27.

Figures 17, 18, 19:
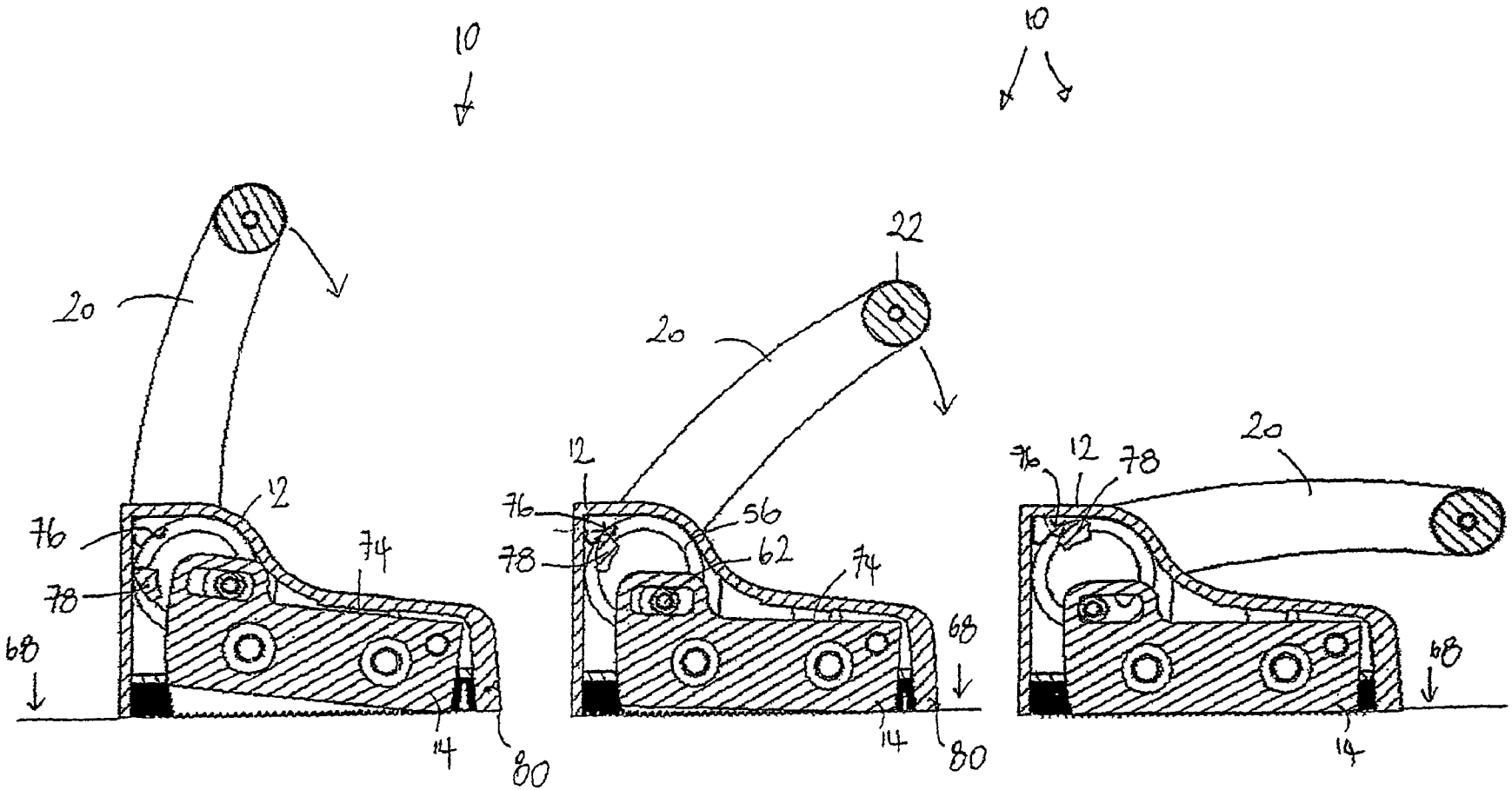
FIG. 17 illustrates a cross sectional side view of the second embodiment of the clamp disengaged from the steel bed.
FIG. 18 illustrates a cross sectional side view of the clamp illustrated in FIG. 17 in partial contact with the steel bed.
FIG. 19 illustrates a cross sectional side view of the clamp illustrated in FIG. 16 in engagement with the steel bed.

The clamp further includes a demagnetising plate 74 located within the housing 12 as illustrated in FIGS. 17 to 19 of the drawings. The demagnetising plate 74 locks the magnet 14 to the housing 12 in the disengaged position until such time as it is required to move the magnet 14 into contact with the steel bed 68. When the magnet 14 is attracted to steel or another magnetic body, the magnetic force on the face opposite (i.e. the face directly opposite the face that is in contact with the steel or magnetic surface) greatly diminishes or disappears. When the magnet 14 is held away from a magnetic surface, the magnetic forces from the top to the bottom of the magnet are about the same. However, when the magnet 14 comes into contact with the steel bed 68, the magnetic field or force on the top of the magnet greatly reduces.

A certain amount of force needs to be exerted so as to break the bond between the magnet 14 and the demagnetising plate 74 with this force being greater than the magnetic attractive force of the magnet 14, in its disengaged position, and the steel bed 68.

Another feature illustrated in FIGS. 5 and 17 to 19 of the drawings is a retaining member 76. The retaining member 76 provides a two stage mechanism where a first application of force on the handle 18 causes only partial contact of the magnet 14 with the steel bed 68 (as shown in FIG. 18) and a second application of force on the handle 18 causes the magnet 14 to move fully into contact with the steel bed 68 (as shown in FIG. 19). The retaining member 76 is a resiliently flexible element, such as a spring steel clip, that engages a catch 78 protruding from the pivot disc 56 to limit rotation and hence suspend the magnet 14 above the surface of the steel bed 68 in the semi-engaged position. A further application of downward force on the handle 18 causes the clips 76 to yield allowing the magnet 14 to move to its fully operative position. This feature assists in supporting the magnet 14 at a close distance to the steel bed 68 to allow the sideform and clamp to be adjusted before there is full contact between the magnet 14 and the steel bed 64.

The rear of the housing 12 is reinforced by a region of increased thickness 80. This region of increased thickness 80 allows the housing 12 to be lightly hit or tapped with an implement such as a hammer, mallet or other object without causing permanent damage or deformation to the housing 12.

The shear force required to move the clamp 10 laterally is only minimal. Light taps to the region of increased thickness 80 will move both the magnet 14 and sideform (not shown) attached to it along the steel bed 68 to enable minor adjustments to be made to the position of the sideforms. If there were no magnetic contact of the magnet 14 with the steel bed 68 at all, and the magnet 14 was simply attached to the sideform by its weight alone, the magnet 14 could not be used to straighten or even bend the sideforms.

In the fully operative position as illustrated in FIG. 19, the magnet 14 is fully in contact with the steel bed 68 thus exerting maximum magnetic attraction with the steel bed 68 and hence providing the maximum shear force inhibiting slippage of the clamp 10.

Figure 20:
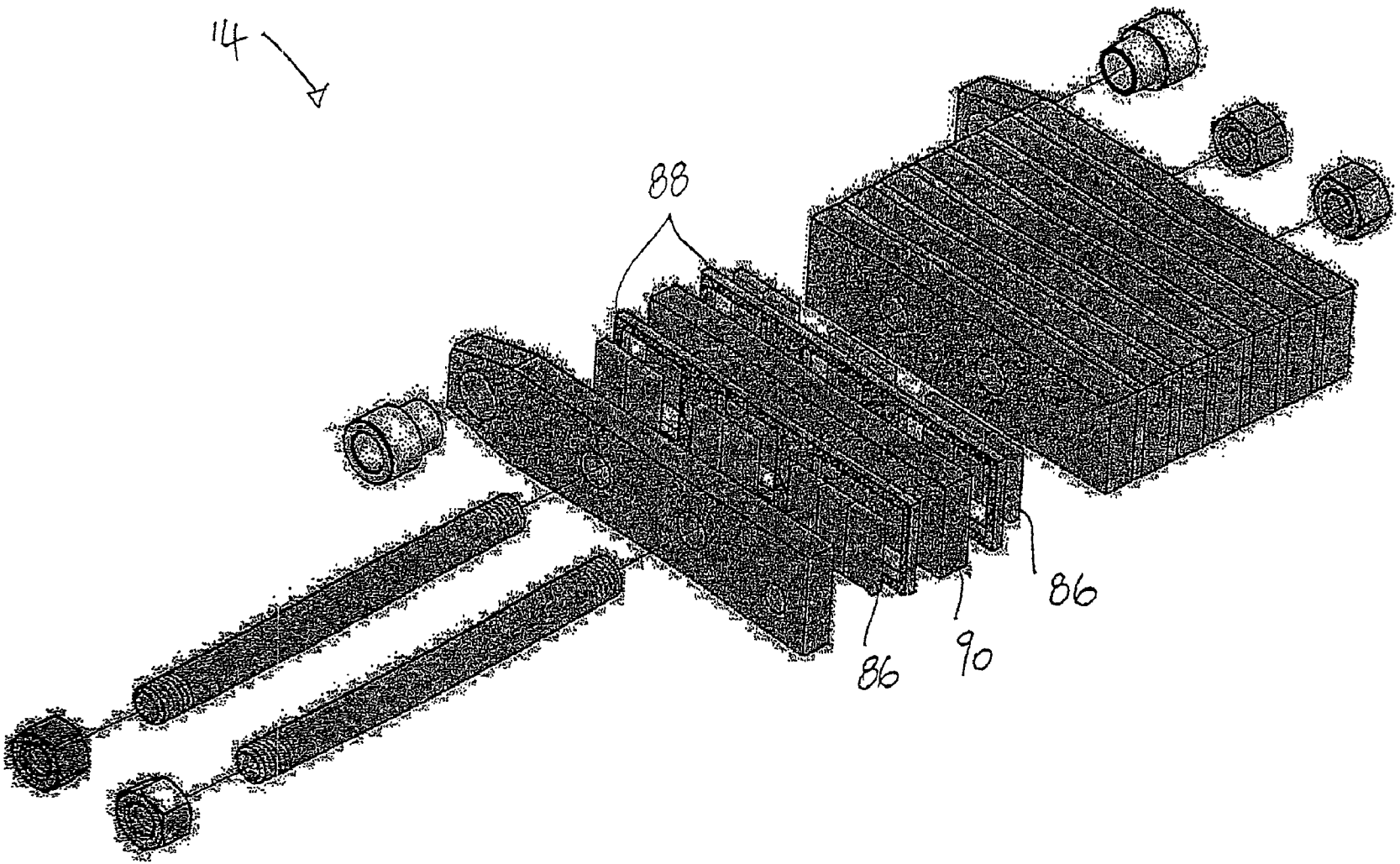
FIG. 20 is a perspective, partially exploded view of a magnet of the clamp.

FIG. 20 illustrates an exploded view of the magnet 14. The magnet 14 is made by inserting slender rare earth magnetic inserts 86 into steel plates 90. Rubber frictional baffle plates 88 are sandwiched between the steel plates 90 carrying the rare earth inserts 86. The baffle plates 88 serve to increase the frictional forces and frictional coefficient between the magnet 14 and the steel bed 68 and are therefore made from extremely soft silicon type rubber. The baffle plates 88 also provide a water resistant protective coating to the inserts 86 and provide impact and vibration absorption.

Figure 21:
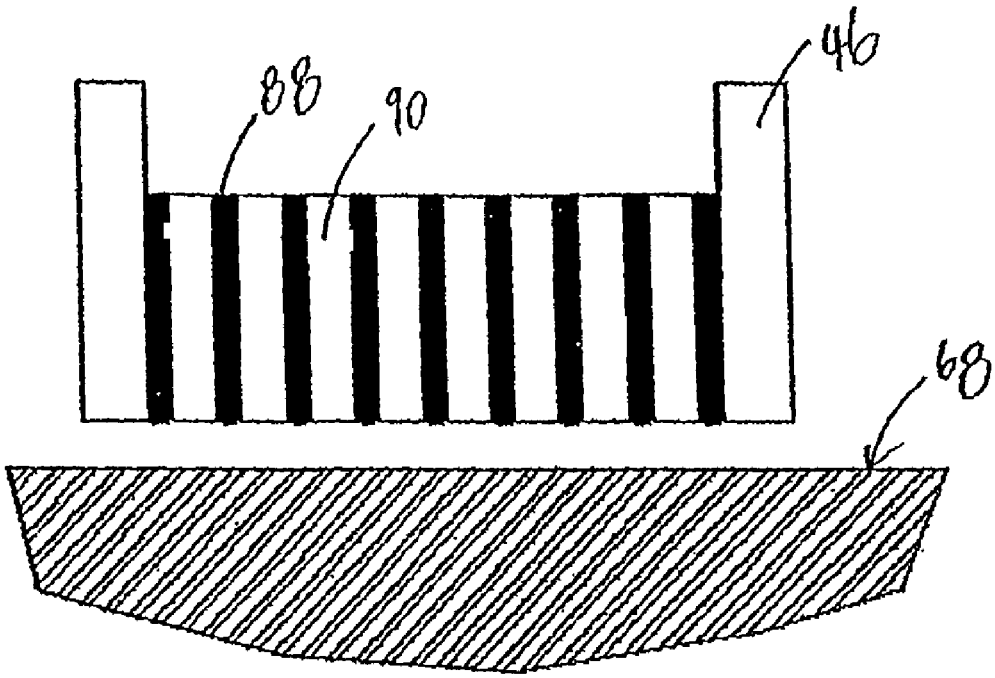
FIG. 21 is a front view of the magnet disengaged from the steel bed.
Figure 22:
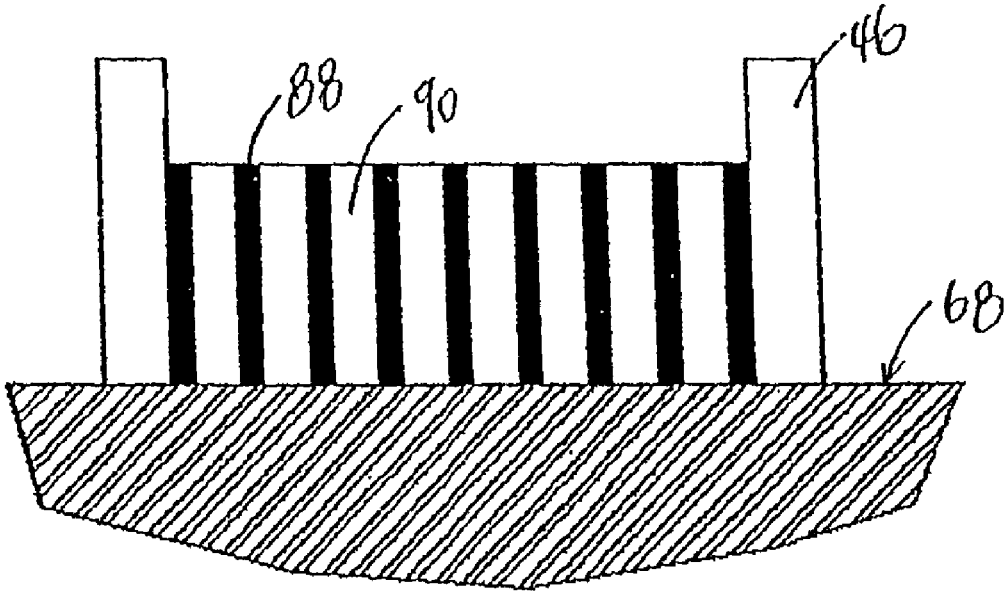
FIG. 22 is a front view of the magnet in contact with the steel bed.

The baffle plates 88 are designed so as to protrude slightly below the bottom face of the steel plates 90 and steel end plates 46 (FIG. 21). The baffle plates 88 are designed so as to be able to be compressed so as not to elevate the magnet 14 off the steel bed 68 at all, i.e. the rubber has compression zones in it to be able to be compressed. Thus, when the magnet 14 comes into contact with the steel bed 68 (FIG. 22), the baffle plates 88 compress thus allowing the steel plates 90 and steel end plates 46 to come into contact with the steel bed 68.

Advantageously, the lever arms 20 are spaced from sides of the housing 12, when both vertical and horizontal, so as to inhibit the operator's hands being caught between the lever arms 20 and the housing 12 and, further, substantially to eliminate shear between the housing 12 and the lever arms 20.

It is an advantage of the invention that fine adjustments are able to be made to the clamp whilst the clamp is attached to a sideform. Furthermore, when the clamp is in the correct position the displacement mechanism is able to be displaced to clamp the magnet to a steel casting bed to support the sideform in position. With prior art lever and screw arrangements this cannot be achieved because to break the magnetic bond with the steel bed the levers and screw mechanisms tilt the entire magnet body, thus the clamp cannot be clamped to the sideform.

It is another advantage of the invention that a clamp is provided which is quick and simple to operate and the use of which involves considerably less labour and force than previous clamps of which the applicant is aware.

It is a further advantage of the invention that the clamp can be connected to a sideform whilst the magnet is in the engaged or disengaged position. In addition, the magnet is able to pivot away from a steel bed without disturbing the relation of the housing to the sideform.

Advantageously, the force amplification mechanism simplifies the operational procedure.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A magnetic clamp for use in clamping a sideform in precast concrete manufacture, the clamp including:

a housing;

a sideform connector for connecting the housing to the sideform;

a magnet displaceably arranged within the housing;

a displacement mechanism displaceably arranged on the housing to displace the magnet relative to the housing; and a force amplification mechanism connected to the magnet, at least a portion of the force amplification mechanism being interposed between the displacement mechanism and the magnet, wherein the displacement mechanism includes an actuator operable to move the magnet between a first, disengaged position and a second, operative position in which the magnet is substantially fully in contact with a magnetic bed on which the clamp is mounted for use so as to clamp the sideform relative to the magnetic bed.

2. The clamp of claim 1 in which the actuator is pivotally connected to the housing adjacent a first end of the housing.

3. The clamp of claim 1 in which the actuator comprises a pair of lever arms, the pair of lever arms being interconnected at their free ends by a handle bar.

4. The clamp of claim 3 in which the force amplification mechanism comprises a linkage mechanism.

5. The clamp of claim 4 in which the linkage mechanism includes a pair of links associated with each lever arm of the actuator.

6. The clamp of claim 5 in which a first link is carried by an end of the lever arm opposite its free end and a second link interconnects the first link and a first end of the magnet at the first end of the housing, the second link being pivotally attached to the magnet and to the first link.

7. The clamp of claim 6 in which the length of the lever arms is substantially greater than the length of the links.

8. The clamp of claim 3 in which the force amplification mechanism includes a cam mechanism.

9. The clamp of claim 8 in which the cam mechanism comprises a bore in each end of the lever arm opposite the free end of the lever arm, each bore being eccentrically arranged relative to a centre of rotation of the lever arm, and a shaft interconnecting the bores.

10. The clamp of claim 9 in which the shaft co-operates with a follower arrangement carried by the magnet.

11. The clamp of claim 10 in which the follower arrangement is formed by a pair of slots, the slots being arranged on opposite sides of the magnet adjacent a first end of the magnet at the first end of the housing.

12. The clamp of claim 1, including a limiting device to limit the extent of displacement of the displacement mechanism and magnet relative to the housing.

13. The clamp of claim 1, including a demagnetising plate to maintain the position of the magnet relative to the housing when in the disengaged position.

14. The clamp of claim 13 in which the demagnetising plate is positioned on or adjacent an interior surface of a roof of the housing.

15. The clamp of claim 1 in which the magnet comprises a plurality of magnetic inserts carried in carriers.

16. The clamp of claim 15 in which the magnet comprises baffle plates sandwiched between the carriers.

17. The clamp of claim 1, including a sideform connector plate releasably connectable to an exterior region of the housing to enable the clamp to be releasably connected to the sideform.

18. The clamp of claim 17 which includes a compensation member releasably connectable to an exterior region of the housing for absorbing vibrational impacts, the compensation member being arranged between the connector plate and the front end of the housing.

19. The clamp of claim 1, including a retaining member arranged to enable the magnet to be suspended in a position intermediate its first position and its second position.

20. The clamp claim 1, including a skirt arranged to increase a frictional coefficient between the magnet and the magnetic bed when the magnet is positioned on the magnetic bed.

21. The clamp of claim 1, including a cover releasably attached to the housing.

* * * * *